United States Patent [19]

Rice

[11] 3,942,790

[45] Mar. 9, 1976

[54] EXERCISING DEVICE

[76] Inventor: Max Rice, 120 MacDougal St., New York, N.Y. 10012

[22] Filed: July 22, 1974

[21] Appl. No.: 490,226

[52] U.S. Cl. ..... 272/79 R

[51] Int. Cl. ..... A63b 21/00

[58] Field of Search..... 272/79 R, 84, 67, 68, 57 R; 273/106 R, 106.5 R, 106.5 A, 106.5 B

[56] References Cited

UNITED STATES PATENTS

| | | | |
|---|---|---|---|
| 1,385,642 | 7/1921 | Restein | 273/106 R X |
| 2,377,498 | 6/1945 | Jacke | 273/106 R |
| 3,069,804 | 12/1962 | Cirafesi | 273/106 R X |
| 3,637,205 | 1/1972 | Bankston | 272/79 R X |
| 3,655,193 | 4/1972 | Jones | 273/106 R |

OTHER PUBLICATIONS

"Teflon" coated aluminum arrow shaft seen personally by examiner Shapiro on Jan. 14, 1972.

*Primary Examiner*—Paul E. Shapiro
*Attorney, Agent, or Firm*—Richard L. Miller

[57] ABSTRACT

A Teflon exercising device for doing isometric physical body movements; the device being made in either of several different models or designs wherein each of which there is an elongated bar having either a ball on each end, or a suction cup for anchoring to any stationary, flat surface; the bar being firmly grasped by the hands while a force is applied on the hands to force them to slide along the axis of the bar, so that the opposing forces exercises and strengthens the muscles.

1 Claim, 8 Drawing Figures

EXERCISING DEVICE

This invention relates generally to body exercising devices.

A principal object of the present invention is to provide an exercising device which improves a person's general good health while giving a relaxing diversion.

Another object is to provide an exercising device that tones up the muscles, releaves tensions, stimulates the circulation, and keeps a person's body trim preventing overweight.

Yet another object is to provide an exercising device that permits a veriety of different exercises so the entire body is exercised.

Other objects are to provide an exercising device that is simple in design, inexpensive to manufacture, rugged in construction, easy to use and efficient in operation.

These and other objects will become readily apparent upon a study of the following specification and the accompanying drawing wherein.

Figures 1, 2, 3, 4, 5, 6, 6A, 7:
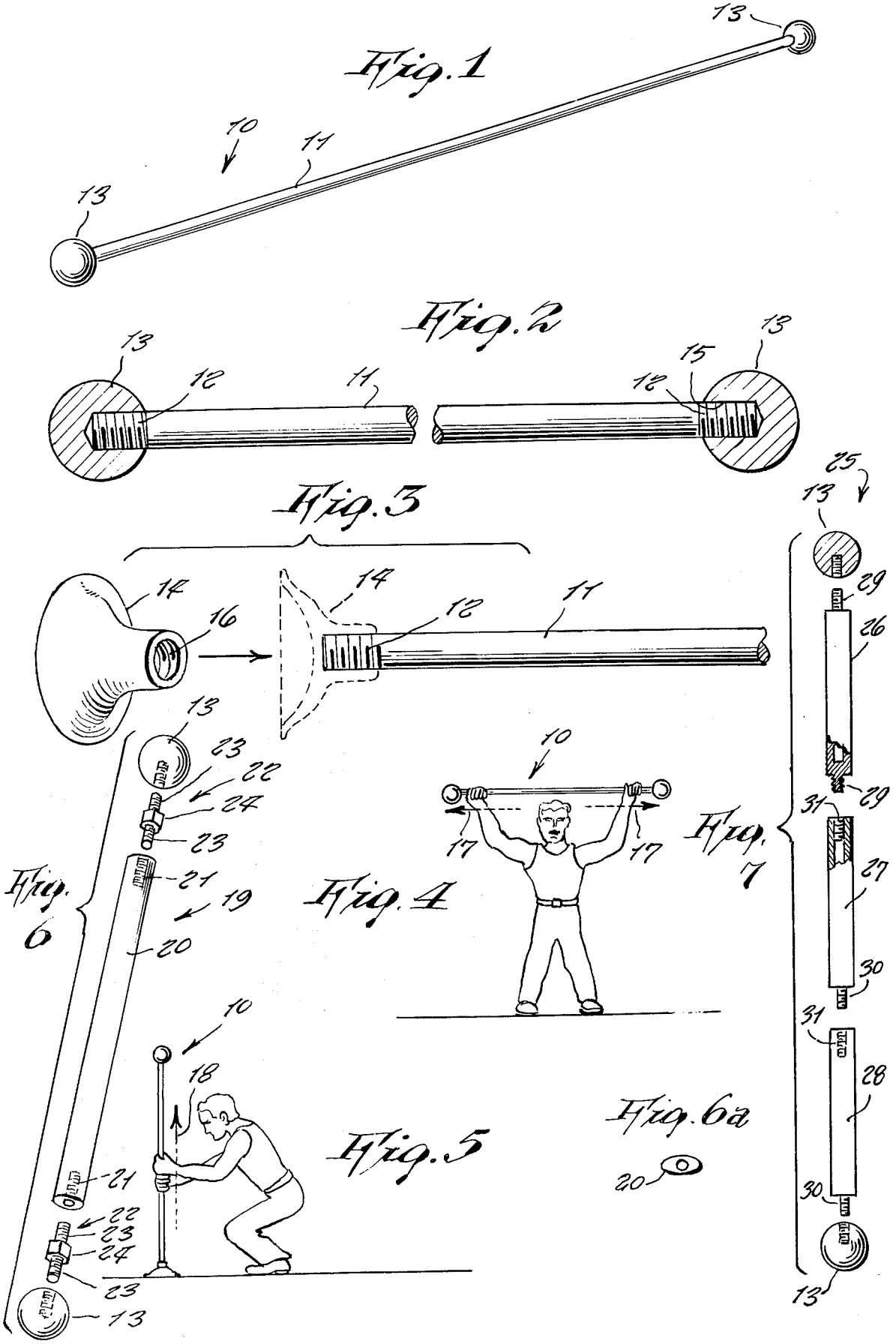
FIG. 1 is a perspective view of the invention.
FIG. 2 is a side view thereof shown with end balls in cross section.
FIG. 3 shows the device set up for securement on a suction cup.
FIGS. 4 and 5 show some of the different exercises that are possible with the invention.
FIG. 6 is an exploded perspective view of a modified design of the invention.

FIG. 6*a* is an end view of the bar shown in FIG. 6.

FIG. 7 is an exploded side view, partly in cross section, of still another modified design of the invention.

Referring now to the drawing in detail, and more particularly to FIGS. 1 to 5 thereof, at this time, the reference numeral 10 represents an exercising device according to the present invention wherein there is an elongated, straight bar 11 of circular section and which is made either entirely of a polytetrafluoroethylene material, generally known by the trademark name of TEFLON, or which otherwise has its outer surface coated therewith. Alternately, the rod can be made of other plastic material which has the characteristic properties of Teflon. The bar, for practical purposes is suggested to be ⅝ inch in outer diameter and between 2 to 5 feet in length.

The both opposite ends of the bar have a screw thread 12 upon each of which there can be screwed either a spherical ball 13 or else a vacuum cup 14. The ball provides a smooth outer end to the assembly, and is made of polished Bakelite material being 1 ¾ inches in diameter. A threaded opening 15 is provided for engaging the threaded bar. The vacuum cup 14 is of conventional type, being made of soft rubber and having a threaded opening 16 on its stem for engaging the bar thread 12.

In use with balls 13, as shown in FIG. 4, the rod may be firmly or loosely grasped, as preferred, while sliding the hands along the bar, as indicated by arrows 17. This can be down overhead, in front, in back, toward a side, between the legs, or in any other position, thus exercising different muscles of the body. When one ball is replaced by a vacuum cup, as shown in FIG. 5, it can be struck hard against a floor, wall, ceiling or other object and both hands can be pulled in a same direction as indicated by arrow 18. Numerous other isometrics are possible to be performed, depending upon the person's own imagination.

In FIG. 6, a modified design of exercise device 19 incorporates a straight bar 20 of oval cross sectional configuration, made of Teflon or the like, as above described, and which has a threaded opening 21 in each opposite end which is engagable by a stud 22 having a thread 23 at each end and a square or hexagonal enlarged portion 24 at its center so to be engagable by a wrench. The spherical ball 13, above described in engagable on one end of each stud 22.

In FIG. 7, still another modified design of exercising device 25 is shown, consisting of three pipe sections 26, 27 and 28, all made of Teflon as stated above, and two balls 13. The pipe 26 has a protruding, threaded screw 29 integral with each opposite end, while each of the pipe sections 27 and 28 are similar to each other by having a protruding, threaded screw 30 at one end and a threaded opening 31 at the other end. As laid out in FIG. 7, it is now evident that all the components can be screwed together to form a single assembly. By leaving out either one or both pipe sections 27 and 28, the assembled bar can thus be made in different desired lengths so to suit children, young teen-agers or adults, or for special exercises when different length bars are more practical to use. It should be further noted that the round pipes 26, 27 and 28 are made of Teflon material coated upon aluminum or other light metal.

Thus various forms of a useful Teflon exercising device is indicated.

While various changes may be made in the detail construction, it is understood that such changes will be within the spirit and scope of the present invention as is defined by the appended claims.

What is claimed is:

1. An exercising bar, comprising in combination, a plurality of three pipe sections and a pair of end balls, and means for removable engagement of said pipe sections and end balls together; said pipe sections being made of a light weight metal and an outer surface thereof is coated with polytetrafluoroethylene material, so to have a characteristic of allowing hands grasping the same to slide along an axis of said bar, all said pipe sections being cross sectionally round and of a same diameter, a first of said pipe sections being integral with a threaded screw protruding axially from each opposite end thereof, while a second and third of said pipe sections each is integral with a threaded screw protruding axially from one end thereof and an opposite end has a threaded opening, each said end ball being made of a plastic material, being spherical in configuration and having a polished surface, said balls being of a larger diameter than a diameter of said pipe sections and each said ball having a radially extending threaded opening; said threaded screws and openings of said pipe sections and said threaded openings of said balls being selectively engagable whereby said exercising bar is assembled in variable length.

* * * * *